US007594863B2

(12) United States Patent
Ban

(10) Patent No.: US 7,594,863 B2
(45) Date of Patent: Sep. 29, 2009

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 11 days.

(21) Appl. No.: 11/941,465

(22) Filed: Nov. 16, 2007

(65) Prior Publication Data

US 2008/0125242 A1 May 29, 2008

(30) Foreign Application Priority Data

Nov. 28, 2006 (JP) ..... 2006-320750

(51) Int. Cl.
*A63B 53/04* (2006.01)

(52) U.S. Cl. ..... 473/331

(58) Field of Classification Search ..... 473/330–331
See application file for complete search history.

(56) References Cited

U.S. PATENT DOCUMENTS

| | | | | |
|---|---|---|---|---|
| 1,965,954 | A | 7/1934 | Davis | |
| 2,005,401 | A * | 6/1935 | Storz | 473/331 |
| 4,753,440 | A | 6/1988 | Chorne | |
| 4,858,929 | A | 8/1989 | Long | |
| 5,437,088 | A | 8/1995 | Igarashi | |
| 5,785,610 | A | 7/1998 | Birmingham | |
| 7,192,361 | B2 * | 3/2007 | Gilbert et al. | 473/290 |
| 2004/0087387 | A1 | 5/2004 | Wahl et al. | |
| 2006/0154739 | A1 | 7/2006 | Mann, Jr. et al. | |
| 2008/0020859 | A1 | 1/2008 | Yamagishi et al. | |
| 2008/0051212 | A1 * | 2/2008 | Voges | 473/331 |

FOREIGN PATENT DOCUMENTS

| | | | |
|---|---|---|---|
| JP | 08-000777 | A | 1/1996 |
| JP | 09-70457 | A | 3/1997 |
| JP | 09-253250 | A | 9/1997 |
| JP | 10-015116 | A | 1/1998 |
| WO | 0002627 | A1 | 1/2000 |
| WO | 0074799 | A1 | 12/2000 |
| WO | 0197924 | A1 | 12/2001 |
| WO | 03045507 | A1 | 6/2003 |

* cited by examiner

*Primary Examiner*—Stephen L. Blau
(74) *Attorney, Agent, or Firm*—Paul, Hastings, Janofsky & Walker LLP

(57) ABSTRACT

A golf club head of this invention includes a face, a plurality of score line grooves formed on the face, and a plurality of striations formed on the face. The angle formed by an arrangement direction of the plurality of striations and the score line grooves is between 40 degrees and 70 degrees, inclusive, as viewed clockwise from a toe side end of the score line grooves.

3 Claims, 9 Drawing Sheets

FIG. 7

| | θ0 (°) | Ra (μm) | SPIN AMOUNT (rpm) | |
|---|---|---|---|---|
| | | | NORMAL | OPEN |
| EXAMPLE 1 | 67 | 4.4 | 6600 | 7200 |
| EXAMPLE 2 | 45 | | 6500 | 7300 |
| COMPARATIVE EXAMPLE 1 | 90 | 0.5 | 3000 | 3500 |
| COMPARATIVE EXAMPLE 2 | | 2.0 | 3300 | 3900 |
| COMPARATIVE EXAMPLE 3 | | 3.0 | 4000 | 4500 |
| COMPARATIVE EXAMPLE 4 | | 4.0 | 5700 | 6200 |
| COMPARATIVE EXAMPLE 5 | | 4.4 | 6450 | 6900 |
| COMPARATIVE EXAMPLE 6 | 23 | | 6000 | 7000 |
| COMPARATIVE EXAMPLE 7 | 0 | | 5600 | 6600 |

GOLF CLUB HEAD

BACKGROUND OF THE INVENTION

1. Field of the Invention

The present invention relates to a golf club head.

2. Description of the Related Art

The face of a golf club head include a plurality of grooves, known as marking lines, score lines, or face line grooves (hereinafter referred to as score line grooves), which affect the spin amount on a ball. It is desirable to have the grooves on an iron club head, especially a wedge, in order to increase the spin amount on the ball. The surface roughness of the face also influences the spin amount of a ball. Japanese Patent No. 3,000,921 discloses a golf club head in which a plurality of fine grooves are formed on the face in addition to the score line grooves.

A wedge gold club head such as a sand wedge or approach wedge is used with the face perpendicular to a target direction, with the face open, or with the face closed. For example, when a player wants to hit a ball high, he or she generally uses the golf club with the face open. When the player wants to roll a ball, he or she generally uses the golf club with the face closed. When the face is directed perpendicularly to the target direction or is open, the larger spin amount of the ball is desirable, and particularly when the face is open, the large spin amount of the ball is desirable.

SUMMARY OF THE INVENTION

It is an object of the present invention to provide a golf club head which can obtain the larger spin amount of a ball.

According to the present invention, there is provided a golf club head comprising a face, a plurality of score line grooves formed on the face, and, a plurality of striations formed on the face, wherein an angle formed by an arrangement direction of the plurality of striations and the score line grooves is between 40 degrees and 70 degrees, inclusive, as viewed clockwise from a toe side end of the score line grooves.

In the golf club head of the present invention, since the plurality of striations are formed, the friction force between the ball and the face can increase and the larger spin amount of the ball can be obtained. In addition, the angle between the arrangement direction of the plurality of striations and the score line grooves is between 40 degrees and 70 degrees, inclusive, as viewed clockwise from a toe side end of the score line grooves. With this arrangement, when the golf club is used with the face open, spin can be easily imparted to the ball, and the larger spin amount can be obtained.

According to the present invention, there is provided a golf club head comprising, a face, and a plurality of striations formed on the face, wherein when the golf club head is placed on a horizontal plane at a defined lie angle and a defined loft angle, an angle formed by an arrangement direction of the plurality of striations and a horizontal direction parallel to the face is between 40 degrees and 70 degrees, inclusive, as viewed clockwise from a toe side end of the golf club head.

In the golf club head of the present invention, since the plurality of striations are formed, the friction force between the ball and the face can increase and the larger spin amount of the ball can be obtained. In addition, the angle between the arrangement direction of the plurality of striations and a horizontal direction parallel to the face is between 40 degrees and 70 degrees, inclusive, as viewed clockwise from a toe side end of the golf club head. With this arrangement, when the golf club is used with the face open, spin can be easily imparted to the ball, and the larger spin amount can be obtained.

Further features of the present invention will become apparent from the following description of exemplary embodiments (with reference to the attached drawings).

BRIEF DESCRIPTION OF THE DRAWINGS

FIG. 7 is a table showing the test results obtained by measuring the spin amount of the ball for Examples 1 and 2 according to the present invention and Comparative Examples 1 to 7;

DESCRIPTION OF THE EMBODIMENTS

Figure 1:
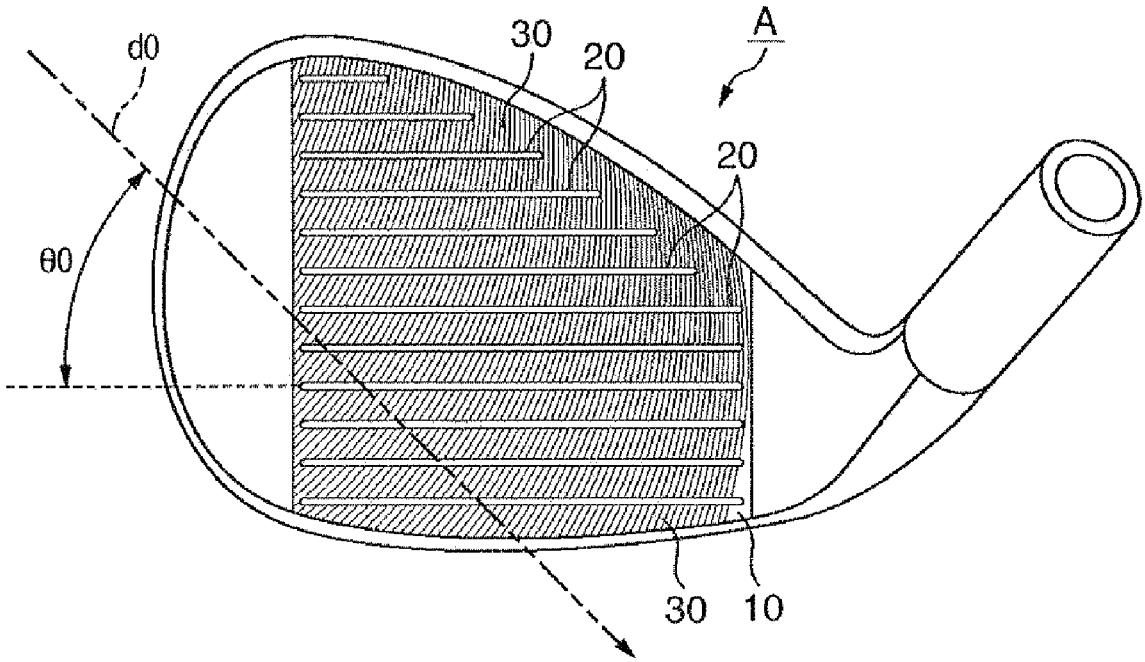
FIG. 1 is an external view of a golf club head A, according to an embodiment of the present invention.

FIG. 1 is an external view of a golf club head A, according to an embodiment of the present invention. The embodiment depicted in FIG. 1 applies the present invention to an iron club head. The present invention is optimized for club heads for which large spin amount is required, especially wedges such as sand wedges, pitching wedges, or approach wedges. The present invention may also be applied to golf club head for the wood type or the utility type.

The face 10 of the golf club head A comprises a plurality of the score line grooves 20. The face 10 is the surface that strikes the golf ball. According to the embodiment, the respective score line grooves 20 are arrayed in straight lines in the toe-heel direction, all in parallel, with equal pitch between the respective score line grooves 20.

Figure 2:
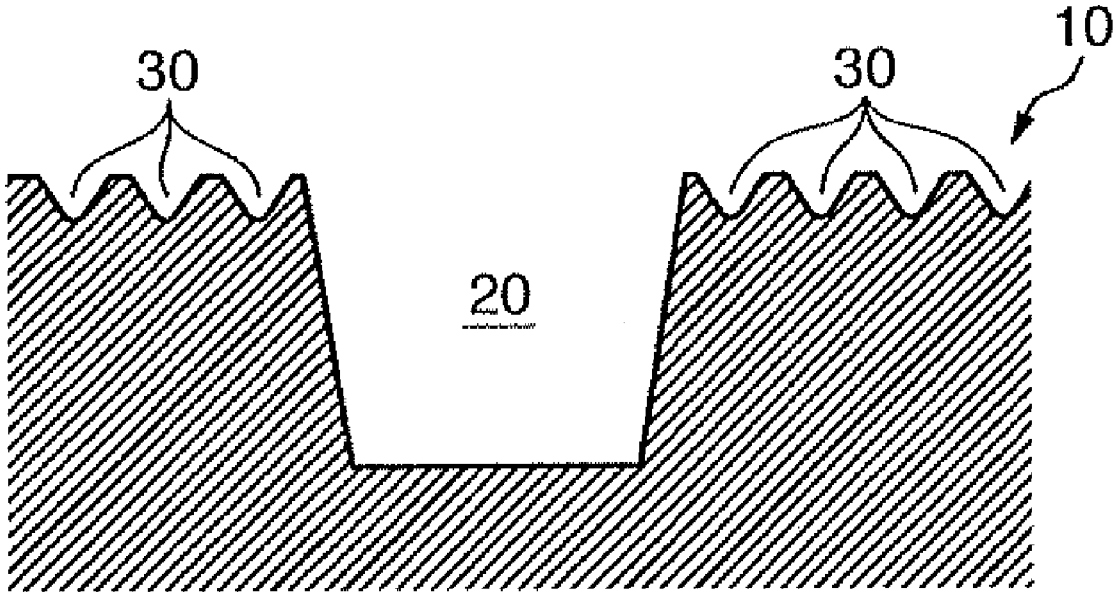
FIG. 2 is a cross-sectional diagram in the vicinity of a score line grooves 20, which cuts at right angles to the lengthwise, or toe-heel direction, of the score line grooves.

FIG. 2 is a cross-sectional diagram in the vicinity of a score line grooves 20, which cuts at right angles to the lengthwise, or toe-heel direction, of the score line grooves. In the embodiment, the cross-section of each score line groove 20 is constant in the lengthwise direction, except at the ends. The score line grooves 20 have the same trapezoidal sectional shape.

Referring to FIGS. 1 and 2, a plurality of striations 30 are formed on the face 10. Each striation 30 is of a significantly small form according to the embodiment, being smaller in cross section area than the score line groove 20. In the embodiment, each striation 30 forms a circular arc, and is shaped so as not to overlap any other striation 30. Also in the embodiment, each striation 30 is an arc of radius identical to every other striation 30.

An arrow d0 in FIG. 1 depicts an arrangement direction of the plurality of striations 30. In the embodiment, each striation 30 is an arc of radius identical to every other striation 30 as described above. The arrangement direction d0 is defined as the direction that passes through the center of the circle of arc of each striation 30. An angle θ0, which is formed by the arrangement direction d0 and the lengthwise direction of the score line groove 20, is between 40 and 70 degrees, inclusive, as measured clockwise from the toe side end of the score line groove 20. With regard to the striations 30 depicted in FIG. 1, the angle θ0 is approximately 45 degrees.

Figure 9:
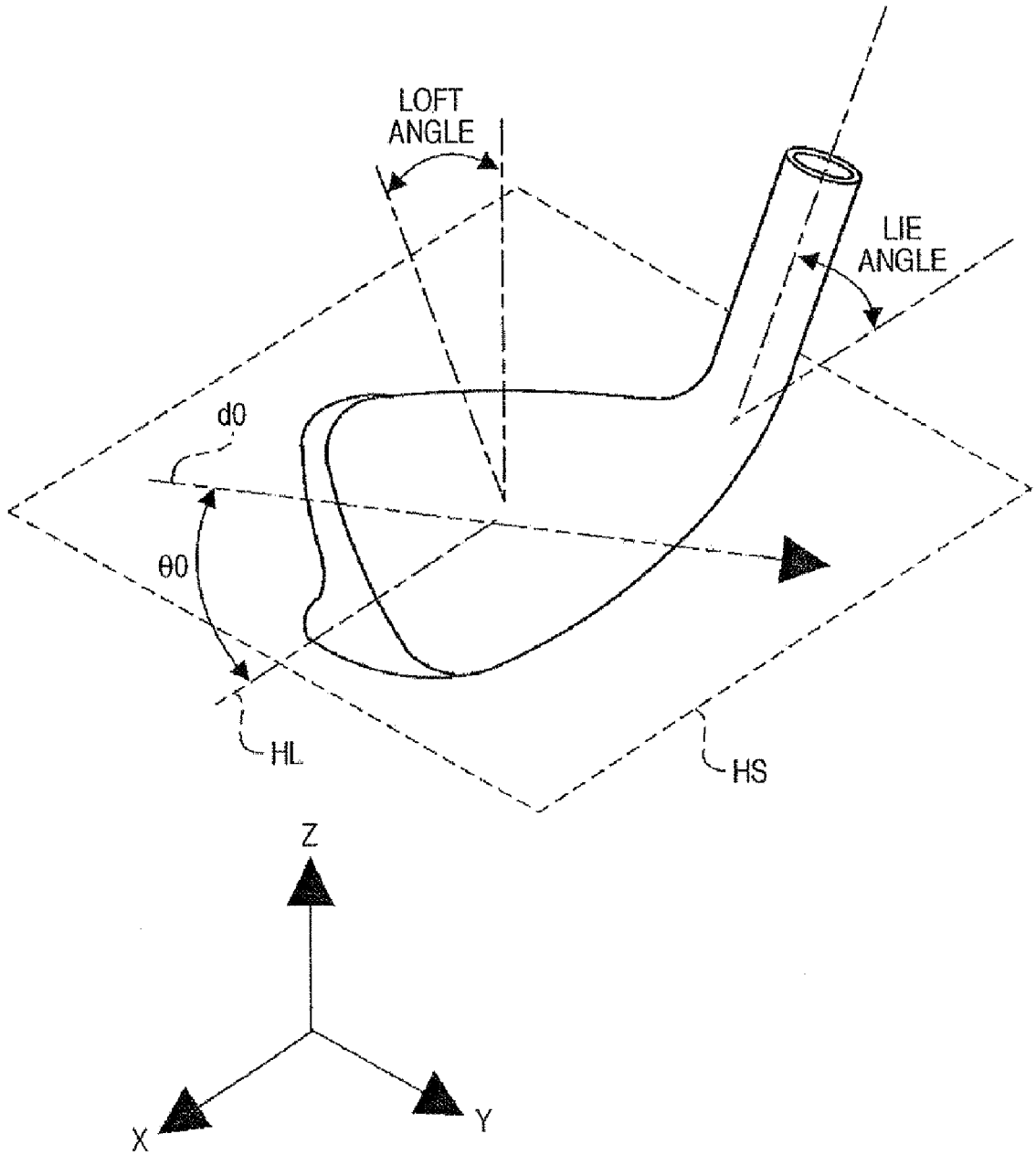
FIG. 9 is a view for explaining another definition method of an angle θ0.

The angle θ0 can be defined by using a method other than the relationship between the arrangement direction d0 and the score line groove 20. FIG. 9 is a view for explaining another definition method of the angle θ0. In the example shown in FIG. 9, the angle θ0 is defined as an angle between the arrangement direction d0 of the striations and a horizontal direction HL parallel to the face when the golf club head is placed on a horizontal plane HS at the defined lie angle and loft angle.

In the example shown in FIG. 9, the angle θ0 is also 40° to 70° (both inclusive) in the clockwise direction from the toe side end of the golf club head. The definition method of the angle θ0 of the example shown in FIG. 9 can be used, for example, when the arrangement direction of the striations is defined in a golf club head in which no score line groove or irregular score line grooves are formed.

Figure 3:
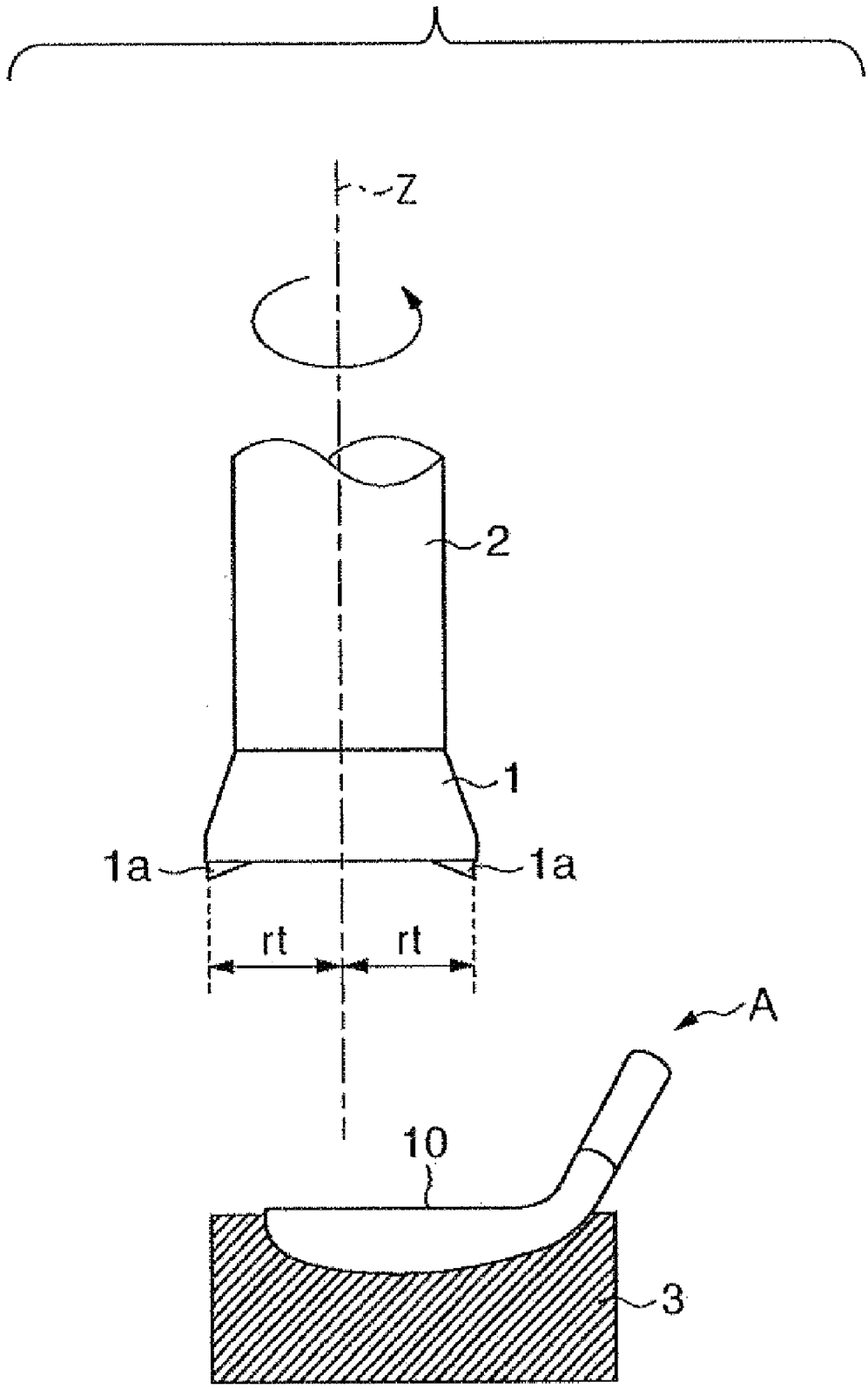
FIG. 3 shows views illustrating a forming method of striations 30 using a milling machine.

The striations 30 can be formed as traces by milling. Milling can be performed using, e.g., a milling machine. FIG. 3 is a schematic diagram illustrative of a forming method of striations 30 using a milling machine. The milling machine comprises a spindle 2 that rotates about a vertical axis Z, and a cutting tool (endmill) 1 is attached to the lower end of the spindle 2. A golf club head A, that has not been formed with the striations 30, fixed with the milling machine by way of a jig 3 so that the face 10 is horizontal. A cutting portion 1*a* of the cutting tool is separated from the vertical axis Z by a distance rt, which is the radius of the circle of arc of each striation 30.

Figure 4:
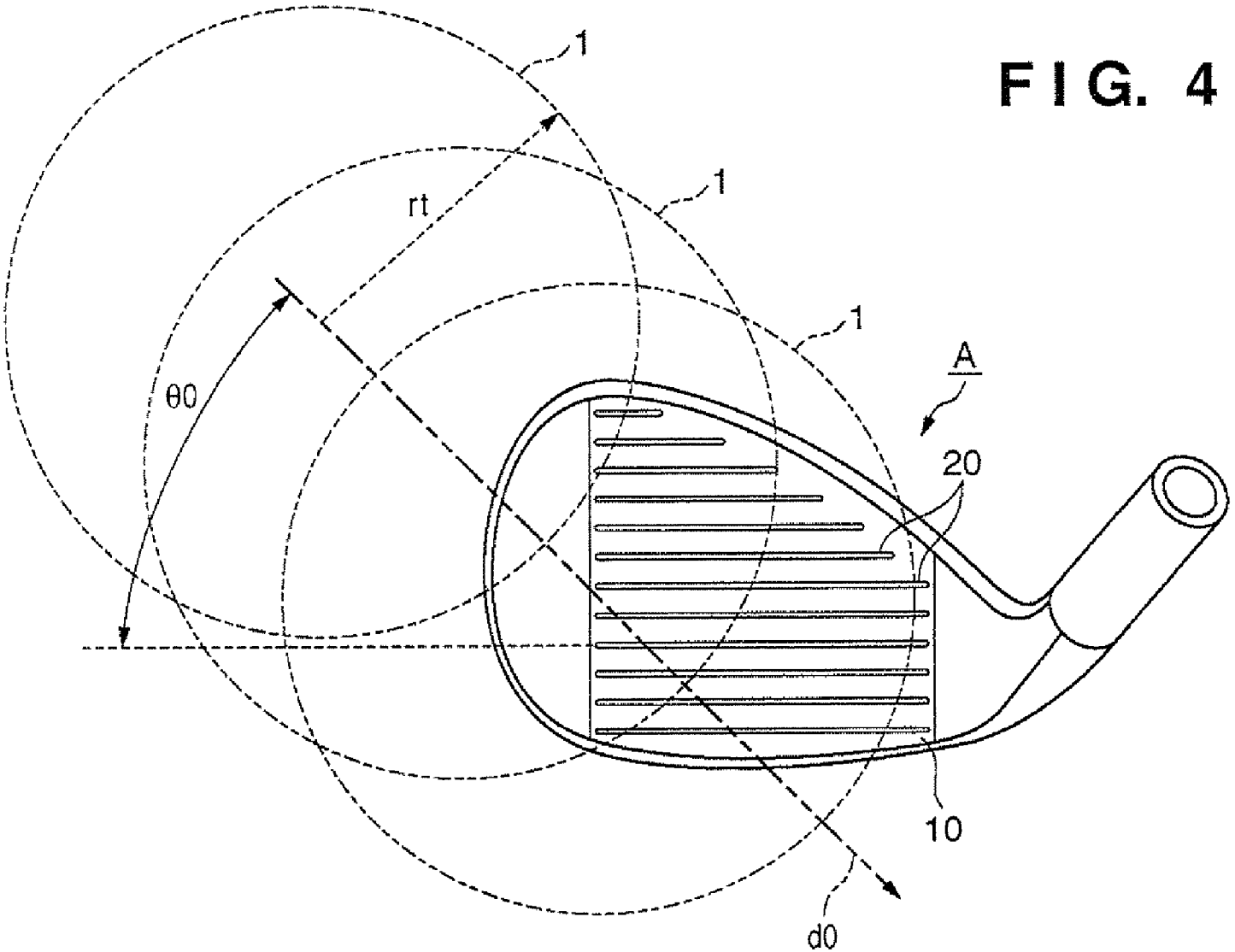
FIG. 4 is a plan view showing a moving path of a cutting tool 1 when milling the striations 30 by milling.

FIG. 4 is a planar view diagram illustrative of a moving path of the cutting tool 1 when milling the striations 30. The relative direction of movement, i.e., the horizontal direction, of the cutting tool 1 and the golf club head A, is identical with the arrangement direction d0 of the striations 30. As the cutting tool 1 is moved in the arrangement direction d0, relative to the golf club head A, the plurality of striations 30 is formed by milling the face 10 with the cutting tool 1. The center of the circle arc of each striation 30, or in other words, the position of the vertical axis Z, passes through the arrangement direction d0. Accordingly, the arrangement direction d0 is the direction that passes through the center of the circle arc of each striation 30. The depth, width, and pitch of each striation 30 is adjusted by the depth of the cut into the face 10 by the cutting tool 1 and the relative moving speed of the cutting tool 1.

The effect of the striations 30 will be described next. In this embodiment, since the plurality of the striations 30 are formed, the surface roughness increases as compared to a case wherein the face 10 is planished. When the surface roughness of the face 10 increases, the friction force between the ball and face 10 increases, and spin can be easily imparted to the ball. As the surface roughness of the face 10 increases, more spin is imparted to the ball. In this case, however, the ball is easily damaged.

Accordingly, it is preferable for the surface roughness of the portion of the face 10 that forms the striations 30 to have the arithmetic mean deviation of the profile (Ra) of between 4.00 μm and 4.57 μm, inclusive. It is also preferable for the maximum height of the profile (Ry) to be not greater than 25 μm. Keeping the surface roughness of the face 10 within the specified range of values also meets the regulations pertaining to the surface roughness of the face of a golf club head to be used in official competition golf.

Figure 5A:
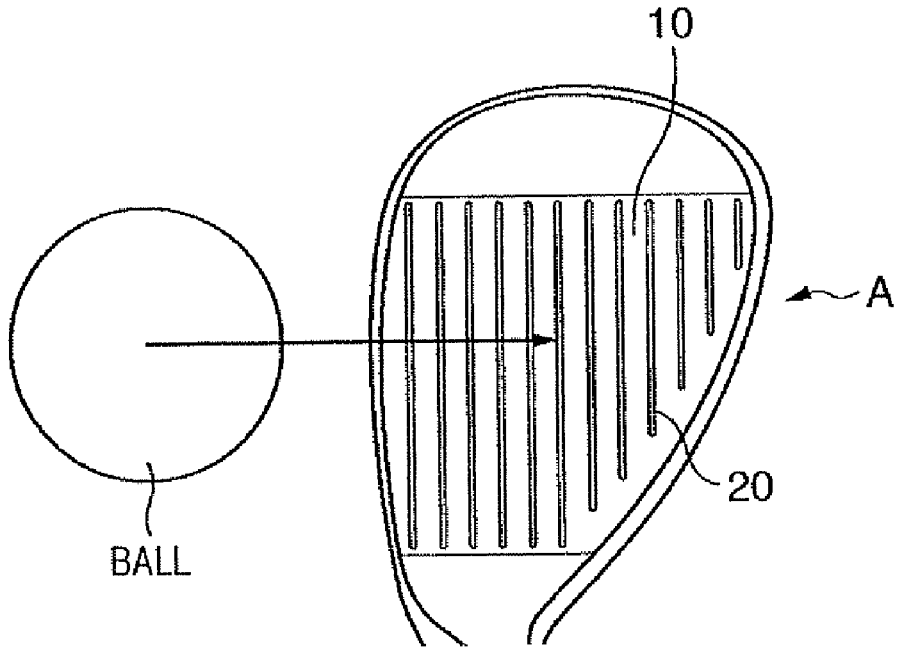
FIG. 5A depicts a face 10 when directly facing in the target direction.
Figure 5B:
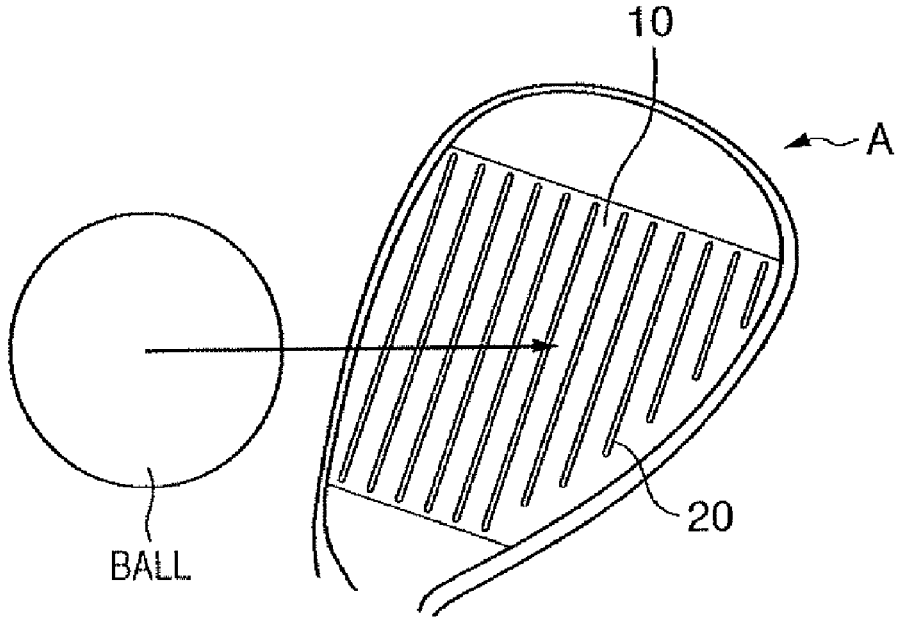
FIG. 5B depicts the face 10 when opened.

Next, in the embodiment, since the angle θ0, which is formed from the arrangement direction d0 of the plurality of striations 30 and the score line groove 20, is between 40 degrees and 70 degrees, inclusive, it becomes easier to impart spin to the ball, allowing obtaining a greater spin amount when using a golf club with the golf club head A when the face 10 is opened, as described in FIGS. 5A and 5B.

FIG. 5A depicts a situation wherein the face 10 is facing directly in the target direction, and FIG. 5B depicts a situation wherein the face 10 is opened. The striations 30 have been omitted from FIGS. 5A and 5B. The arrows in FIGS. 5A and 5B depict the direction of relative movement of the ball vis-a-vis the face 10 at time of impact.

In the embodiment, applying the plurality of striations 30 makes it easier to impart spin to the ball in both the situation shown in FIG. 5A and FIG. 5B. If the face 10 is opened, as depicted in FIG. 5B, results in the ball rubbing against the face 10 at time of impact in such a manner as to intersect the score line grooves 20 at an angle.

Presuming the angle θ0, which is formed by the arrangement direction d0 of the plurality of the striations 30 and the score line grooves 20, to be between 40 and 70 degrees, according to the embodiment, the number of striations 30 that rub against the ball is increased when the face 10 is opened, as depicted in FIG. 5B. To put it another way, the angle of the direction of relative movement of the ball and the striations 30 approaches a right angle. Accordingly, it becomes easier to impart spin to the ball, allowing obtaining a greater spin amount.

Figure 6:
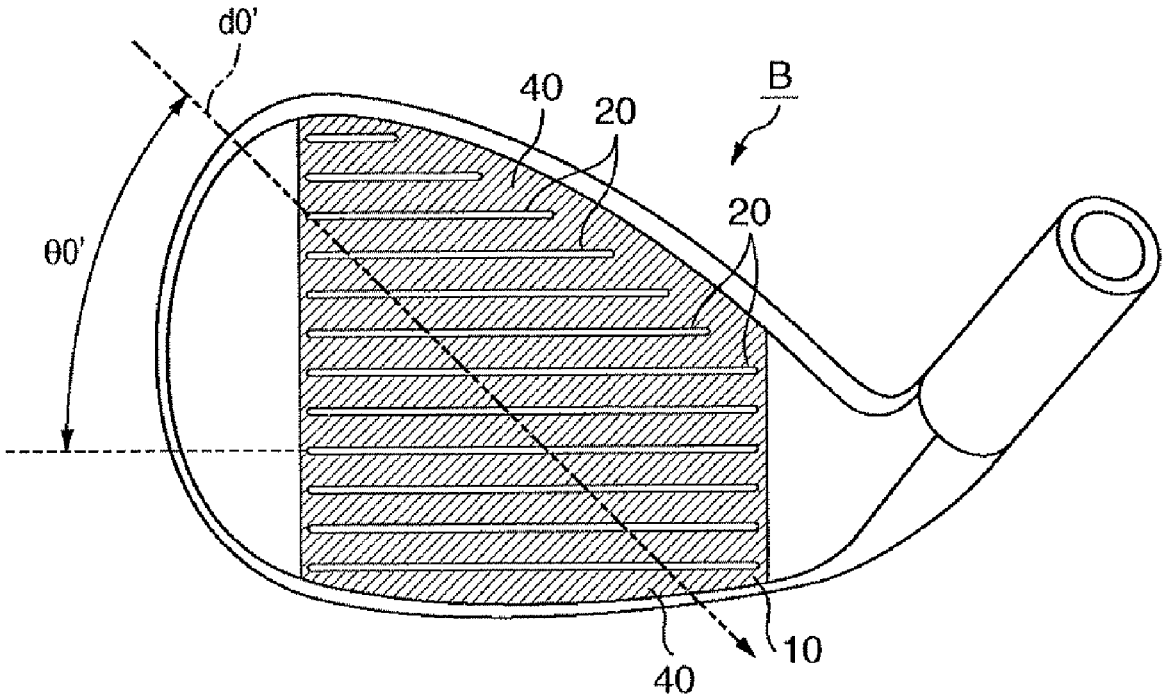
FIG. 6 is a view showing the outer appearance of a golf club head B according another embodiment of the present invention.

While each striation 30 has been formed as a circular arc according to the embodiment, it is possible to form the striations 30 as a straight line as well. FIG. 6 is an external view of an example of a golf club head B with striations in a different shape. The golf club head B is identical to the golf club head A, except for the fact that a plurality of striations 40 are formed of straight lines.

The plurality of striations 40 are mutually formed in parallel. When each striation 40 is straight lines, according to the embodiment, an arrangement direction d0' is defined as a direction that is orthogonal to each striation 40. An angle θ0' formed from the arrangement direction d0' and the lengthwise direction of the score line groove 20 is between 40 and 70 degrees, inclusive, as measured clockwise from the toe side end of the score line groove 20.

Even if the striations 40 have a straight line shape, it is easier to impart spin to the ball, and it is particularly easier to impart spin to the ball when the face 10 is opened, making it easier to obtain a greater spin amount on the ball in either case.

EXAMPLES

FIG. 7 is a table showing the test results obtained by measuring the spin amount of the ball for Examples 1 and 2 according to the present invention and Comparative Examples 1 to 7. All of Examples 1 and 2 and Comparative Examples 1 to 7 are sand wedges with a loft angle of 56° using golf club heads with the circular arc striations 30 shown in FIG. 1. For all of Examples 1 and 2 and Comparative Examples 1 to 7, a cutting tool with a radius (rt in FIG. 3) of 37.5 mm was used to form the striations 30 by milling.

The "θ0" in FIG. 7 is the θ0 depicted in FIG. 1, an angle formed by an arrangement direction of the striations 30, i.e., the d0 in FIG. 1, and the score line groove. The "Ra" is actual measured value of the arithmetic mean deviation of the profile on the face in which the striations are formed.

The "spin amount" in FIG. 7 depicts the spin amount on the ball. The spin amount is calculated by marking the ball prior to the shot, and using a video camera to track the change in the location of the mark at time of impact.

The test involved using golf clubs of Examples 1 and 2 and Comparative Examples 1 to 7, and having three testers hit a golf ball out of the rough, aiming at a target 40 yards away. The three testers hit five balls with the face in direct line with the target direction, and five balls with the face opened. The angle at which the face was opened was left up to the testers' discretion.

The "normal", under the spin amount heading in FIG. 7, is the average value of the amount of spin when the face is in direct line with the target direction, and the "open" is the average value of the spin amount when the face is opened.

Figure 8A:
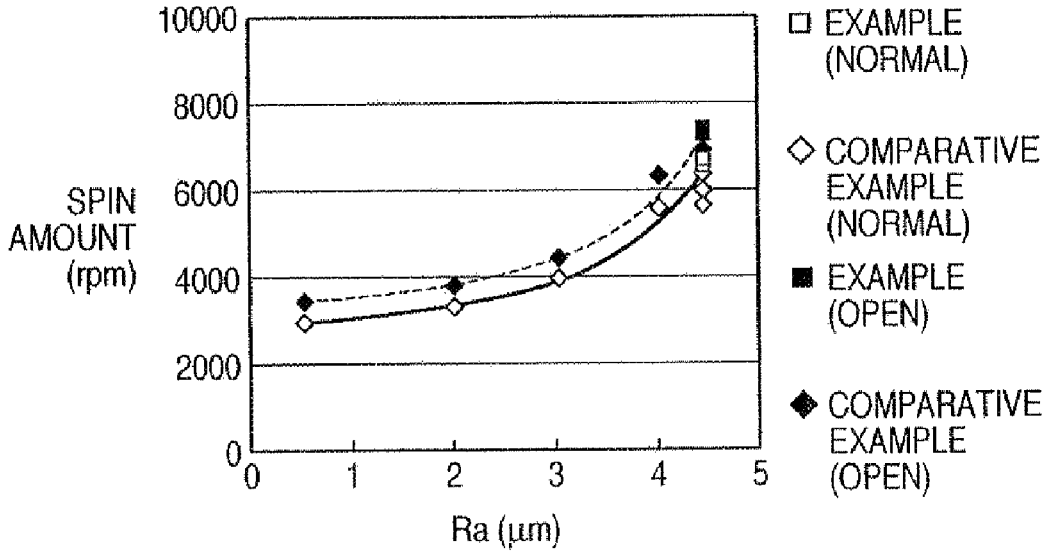
FIG. 8A is a graph showing the "spin amount"-"Ra" relationship of the test results shown in FIG. 7.

FIG. 8A graphs the relationship between the spin amount and the Ra experimental findings depicted in FIG. 7. It is apparent that the rougher the face, the more spin on the ball, for both the normal and the open circumstance. The slope of the plot becomes steeper near the point where Ra reaches 4 μm, which suggests that the Ra of not less than 4 μm is preferable. Taking into account such factors as the fact that the rougher the face, the easier it is to damage the ball, as well as regulations pertaining to the surface roughness of the face on golf club heads that are used in official competition play, suggests that the arithmetic mean deviation of the profile Ra on the face of between 4.00 μm and 4.57 μm, inclusive, is preferable.

Figure 8B:
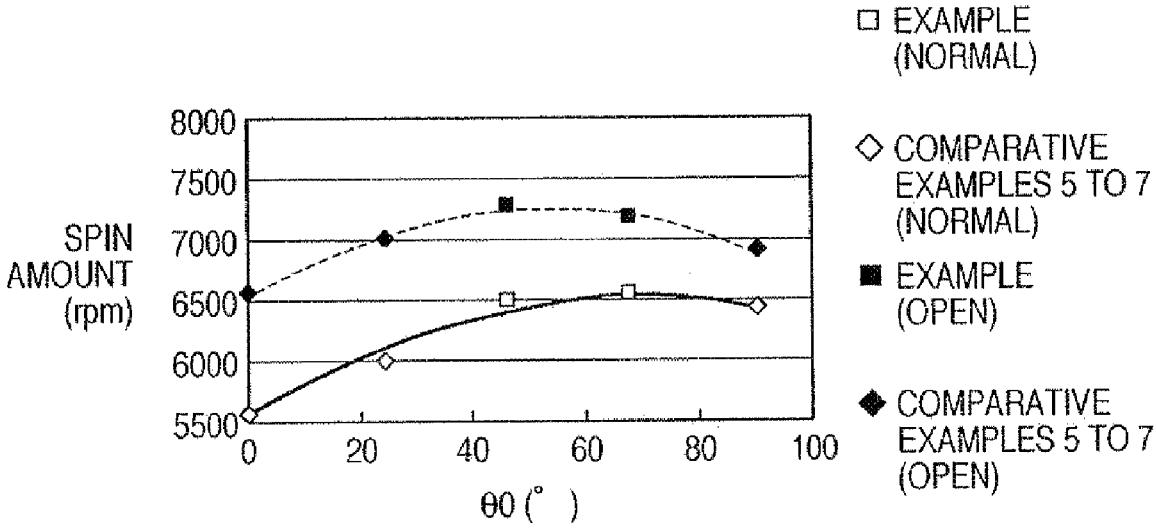
FIG. 8B is a graph showing the "spin amount"-"θ0" relationship of the test results shown in FIG. 7.

FIG. 8B graphs the relationship between the spin amount and the θ0 experimental findings depicted in FIG. 7 for Example 1 and 2 and Comparative Examples 5 to 7, all of which have identical surface roughness on the face, i.e., Ra: 4.4 μm.

It is apparent that the spin amount increases as the θ0 ranges from 0 to the vicinity of 55 degrees, and then declines as the θ0 exceeds 55 degrees, for both the normal and the open circumstance. For the range of θ0 between approximately 30 and 80 degrees, centering on the vicinity of 55 degrees, an spin amount of 7000 rpm or more may be obtained in the open circumstance, which suggests that a sufficient spin amount may be obtained in the open circumstance when the θ0 is between 40 and 70 degrees, inclusive.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-320750, filed Nov. 28, 2006, which is hereby incorporated by reference herein in its entirety.

What is claimed is:

1. A golf club head comprising:

a face;

a plurality of score line grooves formed on the face; and a plurality of striations formed on the face, wherein an angle formed by an arrangement direction of the plurality of striations and said score line grooves is between 40 degrees and 70 degrees, inclusive, as viewed clockwise from a toe side end of said score line grooves wherein each striation forms a circular arc and the arrangement direction is a direction that intersects the center of the circular arc of each striation, wherein said center of the circular arc of each striation is at a different location, and said striations are the only circular arcs on said face.

2. The golf club head according to claim 1, wherein the plurality of striations are formed by milling.

3. The golf club head according to claim 1, wherein said face in which the striations are formed has the arithmetic mean deviation of the profile (Ra) of not less than 4.00 μm and not more than 4.57 μm.

* * * * *